US009694300B2

(12) United States Patent
Daley

(10) Patent No.: US 9,694,300 B2
(45) Date of Patent: Jul. 4, 2017

(54) ROLLING PUSH TOY

(71) Applicant: Everett Kesna Daley, Philadelphia, PA (US)

(72) Inventor: Everett Kesna Daley, Philadelphia, PA (US)

( * ) Notice: Subject to any disclaimer, the term of this patent is extended or adjusted under 35 U.S.C. 154(b) by 276 days.

(21) Appl. No.: 14/269,339

(22) Filed: May 5, 2014

(65) Prior Publication Data

US 2014/0335758 A1 Nov. 13, 2014

Related U.S. Application Data

(60) Provisional application No. 61/855,026, filed on May 8, 2013.

(51) Int. Cl.
*A63H 17/25* (2006.01)
*A63J 19/00* (2006.01)
*A63H 7/02* (2006.01)

(52) U.S. Cl.
CPC ..... *A63J 19/006* (2013.01); *A63H 7/02* (2013.01)

(58) Field of Classification Search
CPC ... A63H 7/00; A63H 7/02; A63H 7/04; A63H 11/10; A63H 11/12; A63H 17/25
USPC ..... 446/269, 272, 275–279, 286, 289, 367
See application file for complete search history.

(56) References Cited

U.S. PATENT DOCUMENTS 151,542 A * 6/1874 Lee ..... A63H 7/04 446/289
171,045 A * 12/1875 Robertson ..... A63H 7/04 446/286
195,136 A * 9/1877 King ..... A63H 7/04 446/277
255,367 A * 3/1882 Whitaker ..... A63H 7/04 446/280
439,801 A * 11/1890 Kerr ..... A63H 7/04 446/277
921,258 A * 5/1909 Kingsbury ..... A63H 7/04 446/286
1,157,171 A * 10/1915 Moore ..... A63H 7/04 446/272
1,273,405 A * 7/1918 Petterson ..... A63H 7/04 446/282
1,276,769 A * 8/1918 Hunt ..... A63H 7/04 446/282
1,506,526 A * 8/1924 Hornastaj ..... A63H 7/04 446/272
1,586,870 A * 6/1926 Wetzell ..... A63H 7/04 446/287
1,587,883 A * 6/1926 Wetzell ..... A63H 7/04 446/286

(Continued)

*Primary Examiner* — Melba Bumgarner
*Assistant Examiner* — Joseph B Baldori
(74) *Attorney, Agent, or Firm* — Dovas Law, P.C.

(57) ABSTRACT

A push toy having a puppet mounted on a first member. Pivotally cross-connected at one end of the first member is a second member having wheels and pivotally cross-connected at the other end of the first member is a third member used for steering. Cables connecting the third member to the second member extend along each side of the first member. The cables extend through the puppet and the feet of the puppet are connected to the second member. As a user pushes the push toy and steers the wheels turn as the puppet moves in a manner such that the puppet appears to be steering the push toy.

13 Claims, 4 Drawing Sheets

(56) References Cited

U.S. PATENT DOCUMENTS 1,587,884 A * 6/1926 Wetzell ..... A63H 7/04 446/286
1,595,586 A * 8/1926 Tiefel ..... A63H 7/04 446/283
1,598,161 A * 8/1926 Smith ..... A63H 7/04 446/285
1,626,756 A * 5/1927 Recatti ..... A63H 7/04 446/272
1,682,235 A * 8/1928 Nordstrom ..... A63H 7/04 446/287
1,686,061 A * 10/1928 Allinger ..... A63H 7/04 446/280
1,688,926 A * 10/1928 Henry ..... A63H 7/04 446/286
1,709,703 A * 4/1929 Atkinson ..... A63H 7/04 446/285
1,724,170 A * 8/1929 Barry ..... A63H 7/04 446/276
1,960,981 A * 5/1934 Stocker ..... A63H 7/04 446/285
2,089,885 A * 8/1937 Fisher ..... A63H 3/28 446/287
2,379,376 A * 6/1945 Rau ..... A63H 7/04 446/283
2,398,025 A * 4/1946 Martin, Jr. ..... A63H 7/04 446/275
2,509,805 A * 5/1950 Briggs ..... A63H 7/04 280/1.201
2,522,405 A * 9/1950 Simon ..... A63H 7/04 446/281
2,570,709 A * 10/1951 Pringle ..... A63H 7/04 446/282
2,723,489 A * 11/1955 Zimbalist ..... A63H 7/04 446/272
2,921,406 A * 1/1960 Mills ..... A63H 7/04 446/289
2,933,852 A * 4/1960 Straitwell, Jr. ..... A63H 7/04 446/287
2,934,854 A * 5/1960 Comfort, Sr. ..... A63H 7/04 446/286
2,988,847 A * 6/1961 Smith ..... A63H 7/04 446/283
3,346,990 A * 10/1967 Holt ..... A63H 7/04 446/274
3,453,772 A * 7/1969 Schneider ..... A63H 7/04 446/276
3,581,435 A * 6/1971 Wingrove ..... A63H 7/04 446/279
3,653,152 A * 4/1972 Levine ..... A63H 11/00 446/237
3,724,124 A * 4/1973 Foley ..... A63H 7/04 446/289
3,729,864 A * 5/1973 Welk ..... A63H 7/04 446/286
4,087,931 A * 5/1978 Maurer ..... A63H 7/04 446/280
4,386,479 A * 6/1983 Terzian ..... A63H 7/04 446/276
5,261,351 A * 11/1993 Sydnor ..... A01K 31/14 119/428
6,692,332 B2 * 2/2004 Jheow ..... A63H 3/46 446/383
7,841,922 B2 * 11/2010 Discoe ..... A63H 7/04 446/465
2014/0335758 A1 * 11/2014 Daley ..... A63J 19/006 446/367

* cited by examiner

ROLLING PUSH TOY

CROSS REFERENCE TO RELATED APPLICATION(S)

This application claims the benefit of U.S. Provisional Application No. 61/855,026, filed May 8, 2013 which is incorporated by reference as if fully set forth.

BACKGROUND

There are many different types of toys to fill the need for play. Some toys are directed to boys, some to girls, some to both boys and girls, and some to adults. One popular genre of toys is rolling toys. Rolling toys such as toy wagons, trains, trucks and cars require active physical and mental participation by their users. Such toys add motion and spatial travel to game play while inducing interactions between the user, the toy, and the surrounding area. Some rolling toys use tracks, some are electrically powered or controlled, but all require active interactions between the user and the toy.

Another popular toy genre is puppets. Puppets have long been popular, possibly because they can represent so many different things and because those that watch or control puppets must actively transfer their own thoughts and emotions into the puppet. Like rolling toys, puppets demand active interactions between the puppet master or watcher and the puppet itself.

SUMMARY

This Summary introduces simplified concepts that are further described below in the Detailed Description of Illustrative Embodiments. This Summary is not intended to identify key or essential features of the claimed subject matter and is not intended to be used to limit the scope of the claimed subject matter.

A toy is provided including a puppet that is connected to a first member. A second member is pivotably connected to the first member. The second member includes a first wheel and a second wheel. The puppet includes a pivoting first appendage and a pivoting second appendage that are connected to the second member.

Beneficially, the puppet also includes a pivoting third appendage and a pivoting fourth appendage. A first line connects the third appendage to the second member and a second line connects the fourth appendage to the second member. The toy further includes a third member that is pivotably connected to the first member, and the first line and the second line are connected to the third member. A handle is connected to the first member. The puppet includes a body that connects to the first appendage, the second appendage, the third appendage and the fourth appendage, while a spring connects the body to the first member. Beneficially, the toy also includes an audio output device which is preferably attached to the first member.

Further provided is a push toy including an elongated first member having an upper end, a lower end, a right side having an extending right apertured tab, and a left side having an extending left apertured tab. A second member having a right wheel end, a left wheel end, a center, a pivoting left foot, and a pivoting right foot is pivotably cross-connected to the first member at the center. A right wheel is on the right wheel end and a left wheel is on the left wheel end. The push toy further includes a puppet having an articulating body with a hip area that is rigidly connected to the first member. The puppet has: a right leg appendage having a bottom end that is connected to the right foot and a top end that is connected to the hip area by a pivoting right hip joint, the right leg further includes a pivoting right knee joint; a left leg appendage connected to the pivoting left foot at its bottom end and to the hip area by a pivoting left hip joint at its top end, the left leg further includes a pivoting left knee joint; a right arm appendage having an apertured bottom end, a pivoting right elbow joint, and a top end connected to the body by a pivoting right shoulder joint; and a left arm appendage having an apertured bottom end, a pivoting left elbow joint, and a top end connected to the body by a pivoting left shoulder joint. The push toy further includes a third member pivotably cross-connected to the first member at the upper end. A right cable is connected to the right side of the third member and routed through the right apertured tab, through the aperture of the right arm appendage and to the right side of the second member to which it is connected. In addition, a left cable is connected to the left side of the third member and routed through the left apertured tab, through the aperture of the left arm appendage and to the left side of the second member to which it is connected.

BRIEF DESCRIPTION OF THE DRAWING(S)

A more detailed understanding may be had from the following description, given by way of example, taken in conjunction with the accompanying Figures. However, the Figures and the detailed description are examples and are not to be considered limiting as many other examples are possible. In the Figures like elements are identified with like symbols, and wherein.

DESCRIPTIVE KEY

Figure 1:
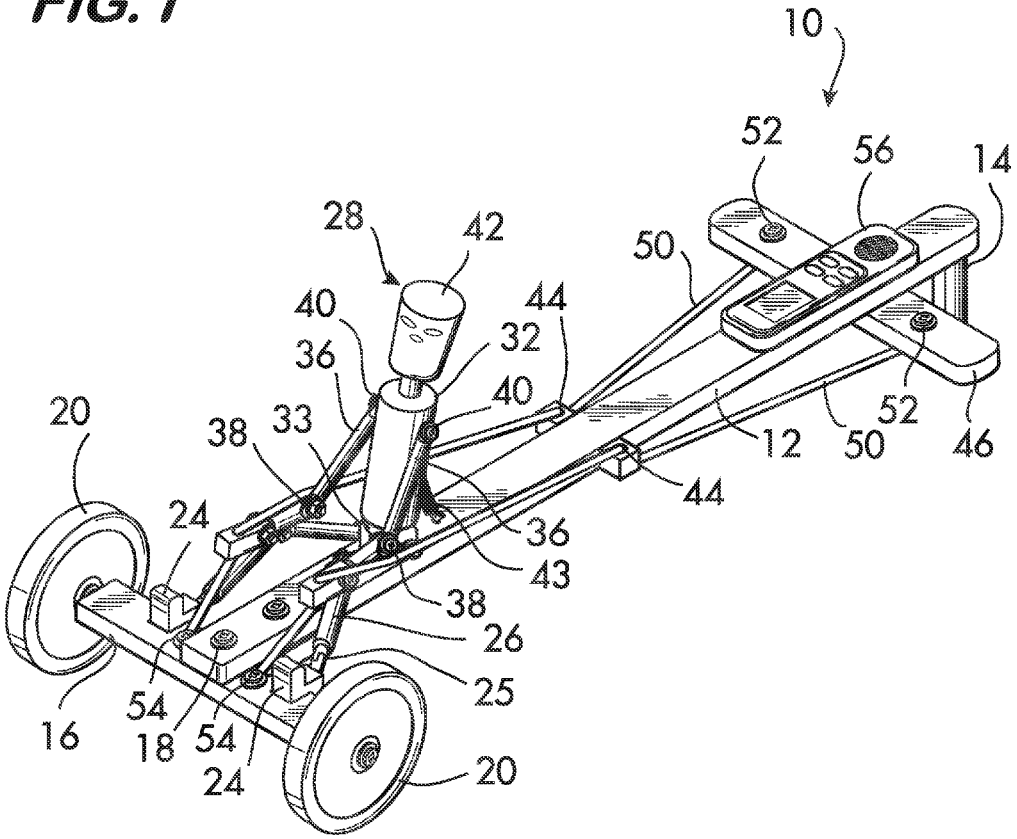
FIG. 1 is a perspective view of a push toy 10.

10 push toy
12 first member
24 foot
26 leg
28 puppet
30 knee
32 body
33 torso joint
34 hip joint
36 arm
38 elbow
40 shoulder joint
42 head
43 spring
44 apertured tab
46 third member
48 pivot joint
50 cable
52 third member cable connector
54 second member connector
56 noise maker

DETAILED DESCRIPTION OF ILLUSTRATIVE EMBODIMENT(S)

The terms "a" and "an" as used herein do not denote a limitation of quantity, but rather denote the presence of at least one of the referenced items. Any directional signal such as top, bottom, side, front, rear, upper, lower, right, and left are to be taken relative to the orientation shown in FIG. 1.

The described illustrative embodiment is not limiting. A person skilled in the art will appreciate that many other embodiments are possible without deviating from the basic concept. Any such work around will also fall under scope of the claimed subject matter. While only one particular configuration is shown and described, that is for purposes of clarity and disclosure and not by way of limitation of scope.

Figure 2:
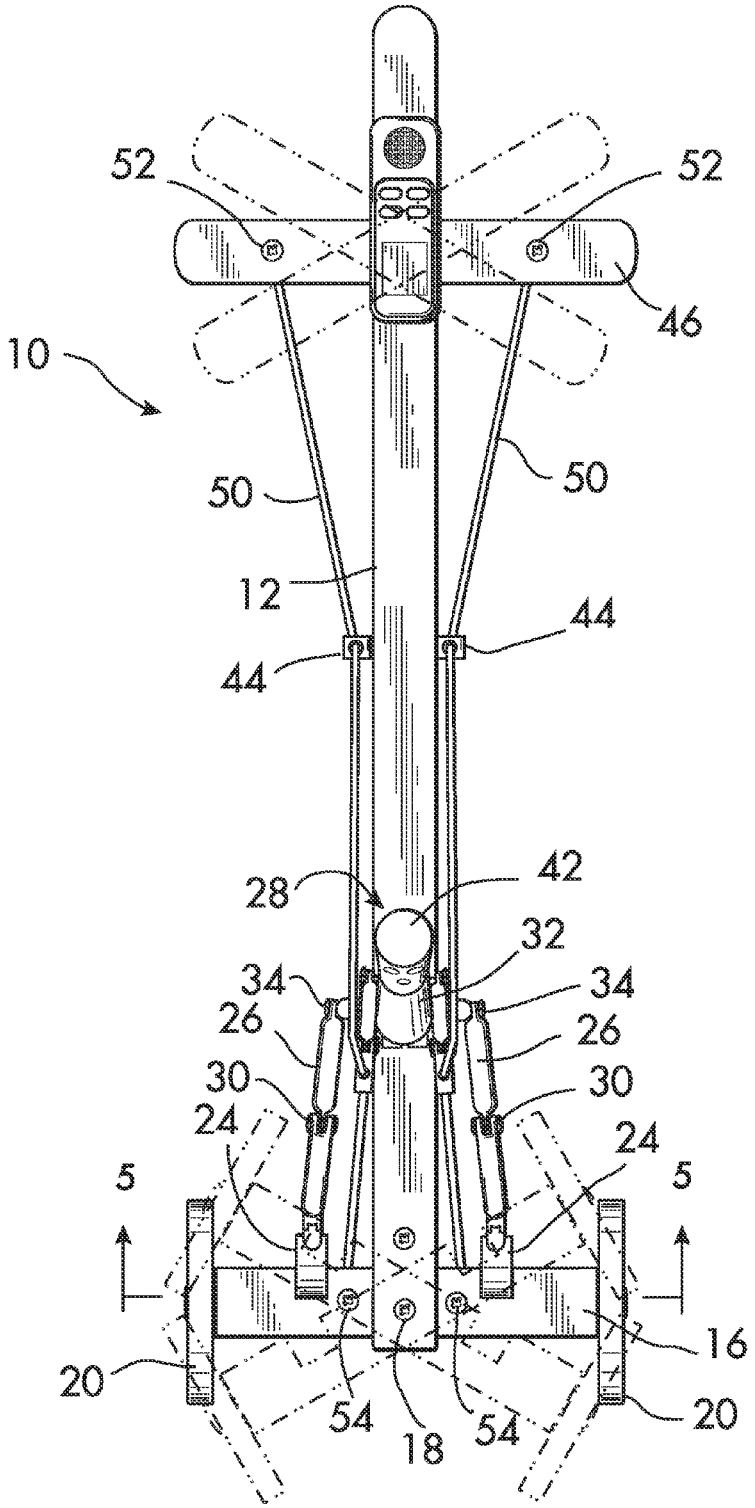
FIG. 2 is a top plan view of the push toy 10 shown in FIG. 1.
Figure 3:
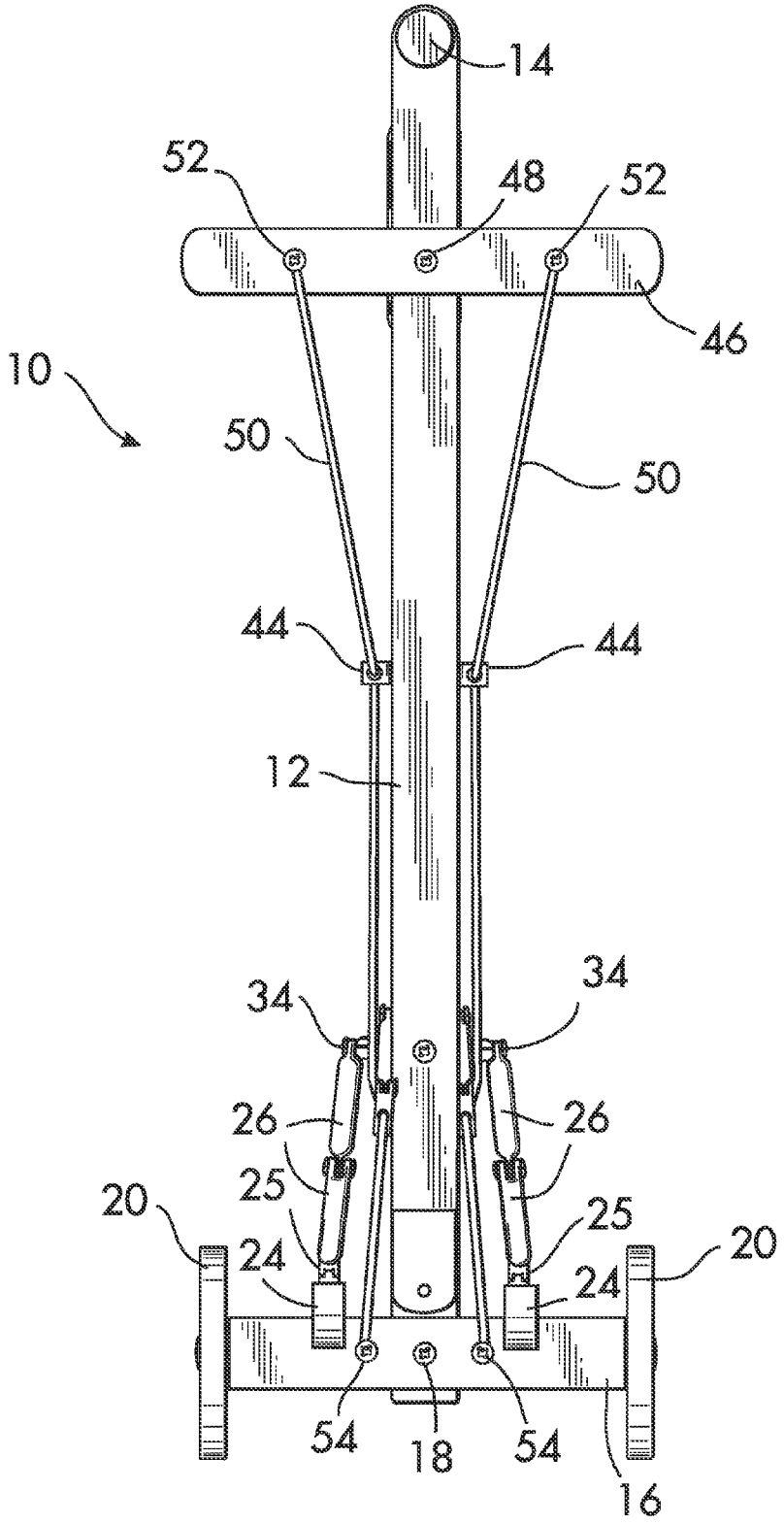
FIG. 3 is a bottom plan view of the push toy 10 shown in FIGS. 1 and 2.
Figure 4:
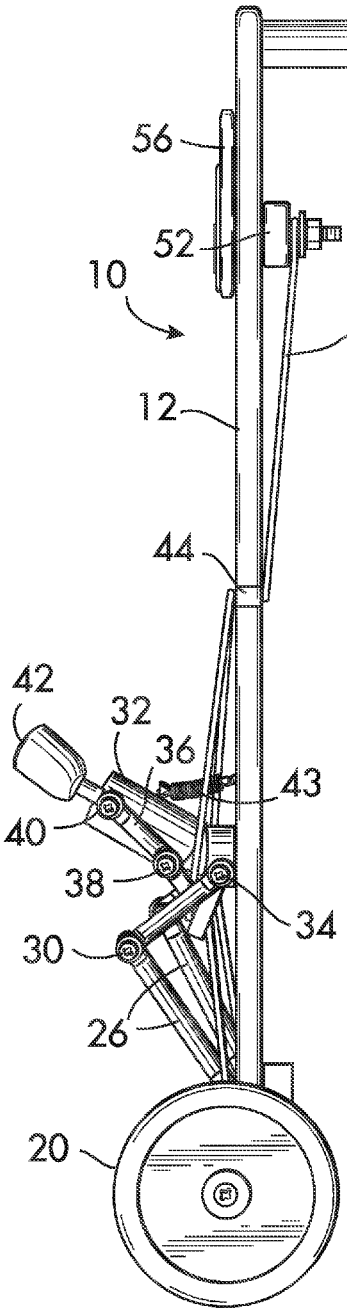
FIG. 4 is a left elevation view of the push toy 10 shown in FIGS. 1-3.

Refer now primarily to FIGS. 1 and 2, respectively perspective and top plan views of an inventive push toy 10 are shown. The push toy 10 includes an elongated first member 12 having a rigid handle 14 at its upper end (the handle 14 is best shown in FIG. 4). At the lower end of the first member 12 is a cross-connected, elongated second member 16. The second member 16 connects to the first member 12 using a center pivoting connection 18. At the ends of the second member 16 are attached wheels 20.

Figure 5:
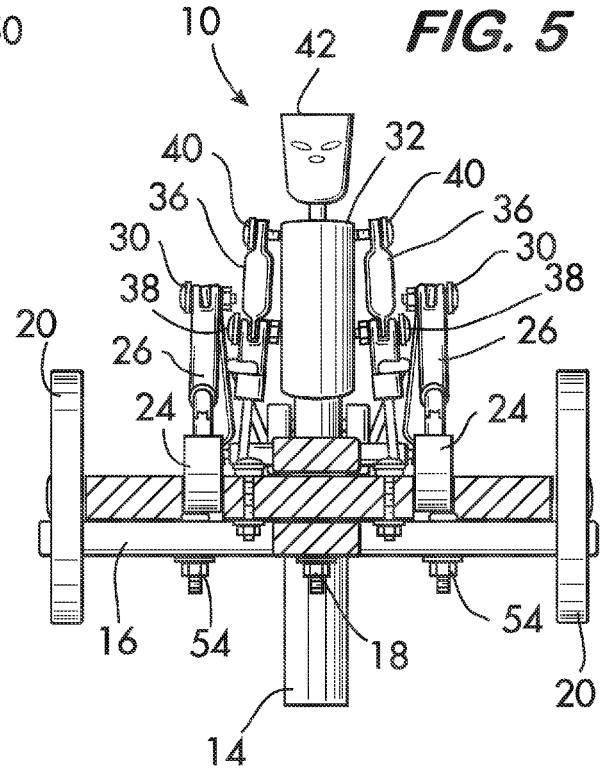
FIG. 5 is a front elevation view of the push toy 10 shown in FIGS. 1-4.

The second member 16 is connected to two feet 24 that are equally spaced about the pivoting connection 18. The feet 24 connect to the bottoms of leg 26 appendages of a puppet 28. As best shown in FIGS. 2, 4 and 5, each leg 26 has a pivoting knee 30, and each leg 26 connects at its upper end to the body 32 by a pivoting hip joint 34. The feet 24 include pivot joints 25 at ankles of the feet 24 allowing the legs 26 to alternately pivot toward and away from the first member 12. The puppet 28 also includes two arm 36 appendages, each of which includes an apertured hand (lowest part of the arm 36) and a pivoting elbow 38, and each of which connects to the shoulder of the puppet 28 using a pivoting shoulder joint 40. The puppet 28 also includes a head 42 having at least a partial face.

Turning now to FIG. 4, the body 32 of the puppet 28 "sits" on the first member 12. The hip area, and thus the hip joint 34, of the body 32 is rigidly attached to the first member 12. However, the upper part of the body 32 is articulated so as to be free to pivot forwards and backwards on a torso joint 33 against the bias of a spring 43.

Returning to FIG. 1, around the middle of the first member 12 are apertured tabs 44 that extend from the sides of the first member 12. Underneath the upper end of the first member 12 and near the handle 14 is a cross-mounted, elongated third member 46. The third member 46 is attached to the first member 12 using a pivot joint 48.

All of the foregoing pivots and pivoting elements are connected to form one operational structure by cables 50 which run along the sides of the first member 12. Cables 50 can include wire, string, rope, twine, or any manner of stranded or solid line of any suitable material. Each cable 50 connects to the third member 46 using a third member cable connector 52. The third member cable connectors 52 are symmetrically connected about half-way between the pivot joint 48 and an associated end of the third member 46. The actual location of the third member cable connectors 52 will depend on the dimensions of the remainder of the push toy 10 and some experimentation may be required to obtain an optimal location.

From their associated third member cable connector 52 each cable 50 routes up through the aperture of the apertured tab 44 on its side of the first member 12. From there each cable 50 routes down through the (hand) aperture of the arm 36 on its side of the first member 12. Finally, each cable 50 is attached to the second member 16 using a second member connector 54.

Referring now to FIGS. 1 and 4, the push toy 10 also includes a noise maker 56. That noise maker 56 emits sound to increase the entertainment value of the push toy 10.

To operate the push toy 10 a user optionally activates the sound maker 56 and lifts the push toy 10 by the handle 14. This enables the push toy 10 to be pushed around on the wheels 20 by the handle 14. As the push toy 10 is pushed it can be steered by gripping the handle 14 and applying a twisting motion resulting in pivoting of the second member 16 relative to the first member 12 via the pivot joint 18.

As the user steers the push toy 10 the cables 50 move. By the routing of the cable 50 the pivoting of the second member 16 on the pivot joint 18 causes the cable 50 to pivot the third member 46 relative to the first member 12 on the pivot joint 48. This pivoting of the third member 46 causes the other cable 50 to be pulled.

Since the puppet legs 26 are attached to the second member 16 via the respective feet 24, the legs 26 pivot on their knees 30 and hip joints 34 and the ankle pivot joints 25. This makes the push toy 10 look like it is being steered by the legs 26 of the puppet 28. In addition, since the cables 50 route through the apertures of the arms 36, as the cables 50 move the arms 36 pivot on their elbows 38 and shoulder joints 40. This makes the push toy 10 also look like it is being steered by the arms 36 of the puppet 28. In addition, the movement of the cables 50 causes the body 32 to move via the torso joint 33 against the bias of the spring 43, which imparts a visual image of the puppet 28 moving forward and backward so as to mimic a human rowing action. The net effect is an interactive push toy 10 that moves on wheels 20 under the control of a user who by steering the push toy 10 operates the legs 26 and arms 36 of a puppet 28 that visually appear to be moving the push toy 10.

For proper operation, the push toy 10 should be symmetrical when the second member 16 is perpendicular to the first member. This creates equal movements of the cables 50 when the second member 16 is moved. It also results in equal movement of the puppet 28 when steered.

While embodiments have been described in detail above, these embodiments are non-limiting and should be considered as merely exemplary. Modifications and extensions may be developed, and all such modifications are deemed to be within the scope defined by the appended claims.

What is claimed is:

1. A push toy comprising:

an elongated first member;

a second member pivotably connected to the first member at a particular pivot joint;

a first wheel connected to the second member at a first end of the second member;

a second wheel connected to the second member at a second end of the second member, the particular pivot joint located between the first wheel and the second wheel;

a puppet having an articulating body with a hip area connected to the first member, the puppet comprising a first appendage connected to the hip area and connected to the second member at a first position and a second appendage connected to the hip area and connected to the second member at a second position, the particular pivot joint located between the first position and the second position, the first appendage comprising at least three pivot joints and the second appendage comprising at least three pivot joints;

a third appendage pivotably connected to the articulating body and comprising a first apertured end;

a fourth appendage pivotably connected to the articulating body and comprising a second apertured end, the articulating body positioned between the third appendage and the fourth appendage;

a third member pivotably connected to the first member, the puppet connected to the first member between the second member and the third member;

a first line connected to the second member and the third member and routed through the first apertured end of the third appendage; and a second line connected to the second member and the third member and routed through the second apertured end of the fourth appendage, the particular pivot joint located between the first line and the second line.

2. The push toy of claim 1, wherein the third member is pivotably connected to the first member at an axis between the first line and the second line.

3. The push toy of claim 2, further comprising:

a first guide connected to the first member, the first line movable within the first guide; and a second guide connected to the first member, the second line movable within the second guide.

4. The push toy of claim 1, further comprising a handle connected to the first member.

5. The push toy of claim 1, the articulating body pivotably connected to the first member at a first location, and the push toy further comprising a spring connected to the articulating body and connected to the first member at a second location.

6. The push toy of claim 1, wherein the first appendage and second appendage comprise legs of the puppet, and the third appendage and fourth appendage comprise arms of the puppet.

7. The push toy of claim 1, further comprising:

an audio output device; and a switch for activating the audio output device.

8. The push toy of claim 1, wherein:

the first appendage of the puppet comprises a first leg of the puppet, and the at least three pivot joints of the first appendage comprise an ankle pivot, a knee pivot, and a hip pivot of the first leg of the puppet;

the second appendage of the puppet comprises a second leg of the puppet, and the at least three pivot joints of the second appendage comprise an ankle pivot, a knee pivot, and a hip pivot of the second leg of the puppet.

9. A push toy comprising:

an elongated first member having an upper end, a lower end, a right side having an extending right apertured tab, and a left side having an extending left apertured tab;

a second member having a right wheel end, a left wheel end, a center, a left foot, and a right foot, wherein the second member is pivotably cross-connected to the first member at the center;

a right wheel connected to the right wheel end;

a left wheel connected to the left wheel end;

a puppet having an articulating body with a hip area rigidly connected to the first member, the puppet further having:

a right leg appendage having a bottom end connected to the right foot by a pivoting ankle and a top end connected to the hip area by a pivoting right hip joint, the right leg further including a pivoting right knee joint;

a left leg appendage connected to the left foot at its bottom end by a pivoting ankle and to the hip area by a pivoting left hip joint at its top end, the left leg further including a pivoting left knee joint;

a right arm appendage having an apertured bottom end, a pivoting right elbow joint, and a top end connected to the body by a pivoting right shoulder joint; and a left arm appendage having an apertured bottom end, a pivoting left elbow joint, and a top end connected to the body by a pivoting left shoulder joint;

a third member pivotably cross-connected to the first member at the upper end;

a right cable connected to the right side of the third member and routed through the right apertured tab, through the aperture of the right arm appendage and to the right side of the second member to which it is connected; and a left cable connected to the left side of the third member and routed through the left apertured tab, through the aperture of the left arm appendage and to the left side of the second member to which it is connected.

10. The push toy according to claim 9, further including a handle at the top end of upper end.

11. The push toy according to claim 9, wherein the body further includes a head having at least a partial face.

12. The push toy according to claim 9, wherein when the third member is perpendicular to the first member the push toy is symmetrical.

13. The push toy according to claim 9, further including an attached noise maker.

* * * * *